United States Patent [19]

Hosono

[11] 4,359,793

[45] Nov. 23, 1982

[54] INFANT CRIB AND STAIRCASE

[76] Inventor: Tsugimori Hosono, 1105 Kipp, Kemah, Tex. 77065

[21] Appl. No.: 144,417

[22] Filed: Apr. 28, 1980

[51] Int. Cl.[3] ..... A47D 7/02; A47D 15/00

[52] U.S. Cl. ..... 5/100; 5/507; 52/182; 182/35; 182/115

[58] Field of Search ..... 5/507, 508, 8, 9 R, 5/9 B, 100, 93 R; 182/35, 115; D6/13, 14; 52/182, 173

[56] References Cited

U.S. PATENT DOCUMENTS

| | | | |
|---|---|---|---|
| 2,059,240 | 11/1936 | Johnston | 5/508 |
| 2,442,048 | 5/1948 | Kroll et al. | 5/100 |
| 2,647,267 | 8/1953 | McLaughlin | 5/9 |
| 4,139,077 | 2/1979 | Pena, Jr. | 5/8 |

*Primary Examiner*—Alexander Grosz

*Attorney, Agent, or Firm*—Neal J. Mosely

[57] ABSTRACT

A guard and staircase unit for a drop-side crib, with vertical rods supporting the drop-side thereof, comprises a supporting framework consisting of a plurality of supporting members arranged in a rectangular support. A plurality of supporting members extend vertically from said rectangular support and support a plurality of steps with the top step being at the level of the crib mattress. A guard barrier wall is supported on said vertically extending support members for positioning along the open side of the crib with the drop-side opened or removed. An opening is provided in the guard barrier wall at the level of the top step. A railing is provided along the side of the steps opposite the wall and around the top step. The unit is provided with eyelets or other suitable fastening means for securing the same to the vertical rods of the crib.

8 Claims, 2 Drawing Figures

INFANT CRIB AND STAIRCASE

BACKGROUND OF THE INVENTION

1. Field of the Invention

This invention relates to new and useful improvements in infant cribs and more particularly to crib having a means for easy entrance and exit of a child therefrom.

2. Brief Description of the Prior Art

Cribs with guard rails on each side have been known for many years. Cribs with drop-sides where one side or both are supported on guide rods for vertical movement are also well known.

In the past, cribs have provided security for small infants but have not been satisfactory for infants after they have reached an advanced crawling or early walking stage. At this level of development, it is often been necessary to provide the infant with a specially designed bed providing for eacy access and security or leave the infant to use the crib and be frustrated in his/her attempt to get into or out of bed without assistance.

Johnston U.S. Pat. No. 2,059,240 discloses a baby crib having an interrupted guard rail with a folding staircase removably mounted therein. This patent provides a very steep staircase for access by the child and also is somewhat complicated for a chile to open or close.

Fitzgerald U.S. Pat. No. 2,659,902 discloses a hospital bed frame with a folding ladder attached thereto.

Cogley U.S. Pat. No. 2,839,765 discloses a folding ladder carried by a pair of bunk beds.

The prior art known to the inventor, in particularly the patents listed above, do not provide any satisfactory solution to giving an infant easy access to a crib bed and thus, providing a structure which is useable from early infancy through early walking steps of development.

SUMMARY OF THE INVENTION

One of the objects of this invention is to provide an improved crib assembly having means for easy entrance by a child of crawling or early walking age.

Another object of the invention is to provide a crib assembly which will hold an infant securely and will also be usable by children of crawling or early walking age.

Another object of the invention is to provide a combined crib, guard wall and stair case for easy access of a small child to bed.

Still another object of the invention is to provide a combined guard wall and staircase unit for use with a drop-side crib.

Still another object of the invention is to provide a combined guard wall and staircase unit which when installed on a drop-side crib provides easy access for a child of crawling or early walking age.

Other objects of this invention will become apparent from time to time throughout the specification and claims as hereinafter related.

A guard and staircase unit meeting the above-stated objects is provided for use primarily with drop-side cribs having vertical rods supporting the drop-side thereof. The unit comprises a supporting framework consisting of a plurality of supporting members arranged in a rectangular supporting base. A plurality of supporting members extend vertically from said supporting base and support a plurality of steps with the top step being at the level of the crib mattress. A guard barrier wall is supported on said vertically extending support members for positioning along the open side of the crib with the drop-side opened or removed. An opening is provided in the guard barrier wall at the level at the top step. A railing is provided along the side of the steps opposite the wall and around the top step. The unit is secured to the crib by eyelets or other suitable fastening means which secure the same to the vertical rods of the crib.

DESCRIPTION OF THE PREFERRED EMBODIMENT

Figure 2:
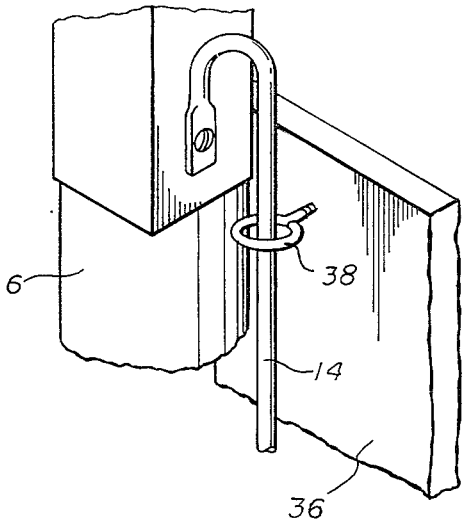
FIG. 2 is a detail isometric view showing the connection of the guard and staircase unit of FIG. 1 to the drop-side crib seen from the line 2—2 of FIG. 1.
Figure 1:
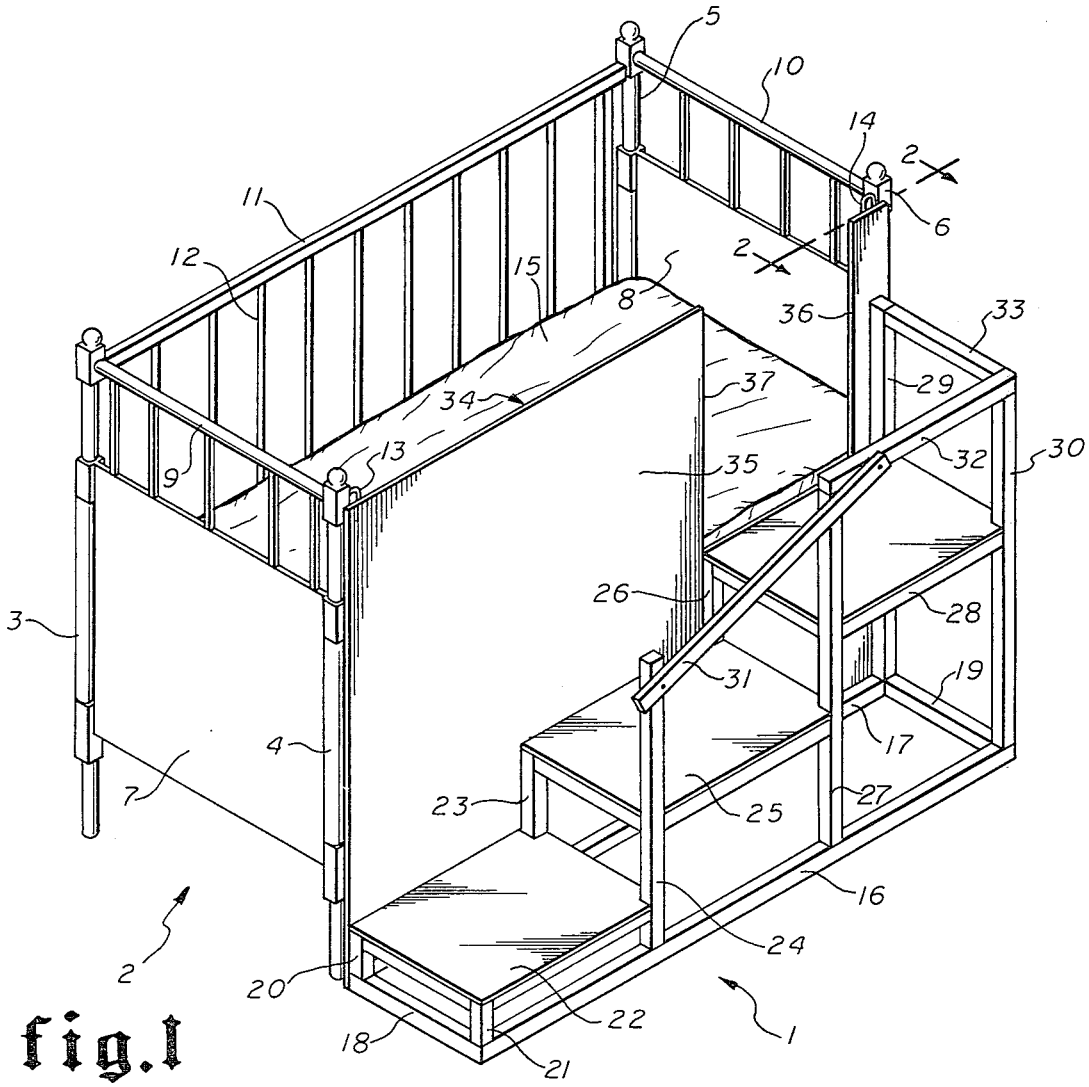
FIG. 1 is an isometric view of a combined guard and staircase unit for drop-side cribs which is a preferred embodiment of the invention.

In FIG. 1, there is shown a guard and staircase unit 1 for use with a drop-side crib 2. Crib 2 is of conventional construction and consists of a plurality of vertically extending rods or support members 3, 4, 5 and 6. Rods 3 and 4 support an endwall 7 and rods 5 and 6 support an endwall 8. Rods 3 and 4 are interconnected at their top ends by horizontal rod 9 and rods 5 and 6 are likewise interconnected by horizontal rod 10. Rods 3 and 5 are inter-connected by horizontal rod 11 and by a lower horizontal rod not shown. Vertical guard rails or rods 12 extend between horizontal rod 11 and the lower horizontal rod. Horizontal rod 11 and the lower horizontal rod and the vertically extending horizontal rods 12 define a guarded side wall to the crib. This side side wall may be in a fixed position, as shown, or may be a drop-side, if desired.

The other side of the bed is provided with a conventional drop-side, not shown, wherein the horizontally extending rods have apertures through which there are positioned vertically extending guide rods 13 and 14 which guide the drop-side for vertical movement. The bed is provided with a suitable set of springs, not shown, which supports a mattress 15. The structure thus far described is a conventional drop-side crib. Cribs of this type are used with small infants and the side of the crib is normally raised when the infant is to be left in the crib and is lowered when the infant is to be removed from the crib. Most infants are incapable of climbing in and out of a drop-side crib without danger of falling and suffering serious injury.

Guard and staircase unit 1 is normally positioned along side the drop-side crib with the side of the crib in an open position or completely removed. Guard and staircase unit 1 have a plurality of supporting members 16, 17, 18 and 19 which are secured together as a rectangular supporting base. A plurality of vertically extending supporting members extend upward from the supporting members in the base and provide the support for a staircase. Vertical supporting members 20 and 21 support one end of the lowermost step 22 of the staircase. The other end of step 22 is supported by vertically extending supporting members 23 and 24. An intermediate step 25 is supported at one end by vertically extending supporting members 23 and 24 and at the other end by vertically extending supporting members 26 and 27. The uppermost top step 28 is supported at one end by vertically extending supporting members 26 and 27 and at the other end by vertically extending supporting members 29 and 30.

A guard rail is provided alone one side of the staircase unit and consists of a guard rail member 31 which extends between vertically extending supporting members 24 and 27. At the top step 28, a guard rail is provided consisting of guard rail member 32 extending between vertically extending support members 27 and 30 and guard rail 33 extending between vertically extending support members 29 and 30.

The staircase unit is provided with a guard barrier wall member 34 consisting of separate wall members 35 and 36 which are secured to the staircase unit by connection to vertically extending support members 20, 23, 26 and 29 by screws or nails or other supporting means. Wall members 35 and 36 are spaced apart far enough to provide an opening 37 at the level of the mattress 15 and the top step 28. Alternatively, wall members 35 and 36 may be intergral and opening 37 may then be merely a cutout opening in a single wall member. On the back side of wall members 35 and 36 there are provided eyelet members 38 which are of a size to fit over vertically extending guide rods 13 and 14. The guard and staircase unit may therefore be secured to the crib by removing the drop-side and positioning the vertical guide rods 13 and 14 through eyelets 38. Eyelets 38 would be normally provided at both the top and bottom portions of wall members 35 and 36 so that the guard and staircase unit would be securely fastened to the crib and would not move away to allow a child to fall out of the bed.

OPERATION

The operation of this apparatus should be apparent from the description of its assembly and the indication of its intended purpose. Nevertheless, a further description of operation will be given to provide for a clearer understanding of the invention.

In using this invention, the drop-side of crib 2 would normally be removed, although it is possible to install the staircase unit 1 with the drop-side merely in a lowered or opened position. The vertical guide rods 13 and 14 are positioned through eyelets 38 to secure the staircase unit 1 in close proximity to the side of crib 2 and secure the staircase unit against movement away from the crib by the child. The unit has three steps (more could be used if desired) which extend along the length of the crib and are the size such that a child is not likely to fall from them. The steps are also of a relatively low vertical height from step to step and make it easy for a child to use the staircase. The uppermost or top step 28 is positioned at the level of crib mattress 15 and at opening 37 between vertical guard wall members 35 and 36. When the staircase unit is installed in position, as shown, a child of crawling or early walking age can climb up the staircase and into bed easily or can climb out of bed and down the staircase, as desired. This combined staircase and crib assembly has proven itself in actual use and makes it possible to use an infants crib for an extended period of time in the childs development.

While this invention has been described fully and completely and with special emphasis upon a preferred embodiment, it should be understood that, within the scope of the appended claims, the invention may be practiced otherwise than as specifically described herein.

I claim:

1. A guard and staircase unit for use with a drop-side crib having vertical rods on which the drop-side is guided comprising a framework including a plurality of supporting members, a plurality of steps supported on said framework and adapted to be supported lengthwise along the drop-side of a drop-side crib, a guard barrier supported on said framework in juxtaposition to said steps and being of a size and shape providing an opening adjacent to the top one of said steps, and means for securing said framework and guard barrier in juxtaposition to the drop-side of a crib with said drop-side open or removed, with said guard barrier in guarding relation to the crib when assembled thereon, and said opening providing an entrance or exit substantially at the bed level from the top one of said steps.

2. A guard and staircase unit according to claim 1 in which said securing means comprises a plurality of connector members supported on said unit for connection to the vertical rods of a drop-side crib.

3. A guard and staircase unit according to claim 2 in which said connector members are eyelets of a size and in a position to fit over the vertical rods of a drop-side crib.

4. A guard and staircase unit according to claim 1 in which the top one of said steps is at a level for alignment with the mattress of the crib when assembled thereon.

5. A guard and staircase unit according to claim 1 in which said framework includes supporting members and a guard rail along said steps on the side opposite said guard barrier.

6. A guard and staircase unit according to claim 1 in which said guard barrier is a vertically extending wall supported on said framework and ending at the top one of said steps.

7. A guard and staircase unit according to claim 1 in which said supporting members comprise a plurality of horizontal members joined in a rectangular base, a plurality of vertically extending supporting members secured on and extending from said base, said steps being supported on said vertically extending supporting members in stepped relation with the top step being at the level of the mattress of the crib when assembled thereon, said guard barrier comprising a vertically extending wall supported on said vertically extending supporting members on one side of said steps, a guard rail secured on selected ones of said vertically extending supporting members on the side of said steps opposite said guard barrier and at the side and end of said top step, and said securing means comprising eyelets supported on at least one of said vertically extending supporting members in position for attachment over one of the vertical rods of the crib to secure said unit in place with said guard barrier, said top step and said barrier opening adjacent to the drop-side of the crib when assembled thereon.

8. The combination with a drop-side crib of a guard and staircase unit according to claim 1, 2, or 7.

* * * * *